US006717082B1

(12) United States Patent
Wu

(10) Patent No.: US 6,717,082 B1
(45) Date of Patent: Apr. 6, 2004

(54) WATERPROOF PUSHBUTTON

(76) Inventor: Chih-Yuan Wu, 8 Fl., No. 66, Chung-Chen Rd., Hsin-Chuang City, Taipei Hsien (TW)

( * ) Notice: Subject to any disclaimer, the term of this patent is extended or adjusted under 35 U.S.C. 154(b) by 0 days.

(21) Appl. No.: 10/327,841

(22) Filed: Dec. 23, 2002

(51) Int. Cl.[7] ..... H01H 13/06
(52) U.S. Cl. ..... 200/302.2
(58) Field of Search ..... 200/302.1, 302.2, 200/302.3

(56) References Cited

U.S. PATENT DOCUMENTS 4,825,023 A * 4/1989 Morse ..... 200/302.2
4,897,516 A * 1/1990 Wakatsuki ..... 200/302.2

* cited by examiner

*Primary Examiner*—James R. Scott
(74) *Attorney, Agent, or Firm*—Dellett & Walters

(57) ABSTRACT

A waterproof pushbutton consists of a body, a button housing and a cover with a hollow shaft. The button housing has a retractable sleeve with an annular shoulder, and the body has an outer lip and an inner lip. A seal device comprises a compression fitting, and an elastic seal with an outer and an inner flange. The zeal is securely mounted on the annular shoulder of the retractable sleeve, and the hollow shaft presses down on the inner flange of the elastic seal. The compression fitting is securely attached to the outer flange of the elastic seal to mount the elastic seal between the outer and inner lip of the body.

1 Claim, 4 Drawing Sheets

WATERPROOF PUSHBUTTON

BACKGROUND OF THE INVENTION

1. Field of the Invention

The present invention relates to a sealing device for a pushbutton, and more particularly to a pushbutton that prevents water or dust from getting inside the pushbutton.

2. Description of Related Art

With reference to FIG. 4, a conventional sealing device for a pushbutton assembly is adapted to provide a seal between a moveable switch (20) and a button housing (40). The button housing (40) comprises a mounting sleeve (42), a retractable sleeve (44) and an elastic seal (46). The moveable switch (20) comprises an outer cover (22) and a hollow shaft (24), and the hollow shaft (24) engages the retractable sleeve (44) and attaches to the elastic seal (46). The elastic seal (46) has an outer circumference (not numbered) and an inner circumference (not numbered). An outer flange (462) is formed on the outer circumference of the elastic seal (46) and extends radially inward. An inner flange (464) is formed on the inner circumference of the elastic seal (46) and extends inward.

The button housing (40) is integrally formed with the pushbutton body (60), and the retractable sleeve (44) is securely mounted around the hollow shaft (24) of the moveable switch (20). The retractable sleeve (44) and the hollow shaft (24) are slideably engaged in the button housing (40). The mounting sleeve (42) is attached to the housing (40) with the outer flange (462) of the elastic seal (46) compressed down. Therefore, when the pushbutton is pushed down, the hollow shaft (24) pushes the retractable sleeve (44) down, which stretches the inner flange (464) of the elastic seal (46). The hollow shaft (24) holds the inner flange (464) of the elastic seal (46) down by friction and results in sealing the pushbutton. The elastic seal (46) is stretched to fit between the hollow shaft (24) and the mounting sleeve (42), but the long-lasting deformation causes permanent deformation of the elastic seal (24). The permanent deformation of the elastic seal (24) potentially allows liquid to leak into the body (60) of the pushbutton, and the life of the pushbutton is shortened.

To overcome the shortcomings, the present invention provides an improved sealing device for a pushbutton to mitigate the aforementioned problems.

SUMMARY OF THE INVENTION

The primary objective of the present invention is to provide an improved waterproof pushbutton, which comprises a body, a button housing and a cover with a hollow shaft. The body has an outer lip and an inner lip. The button housing comprises a retractable sleeve with an annular shoulder. An elastic seal is provided with inner and outer flanges and a compression fitting. With the inventive feature, the pushbutton has an advantage such as a tighter fit between the hollow shaft and the button housing that is less likely to leak.

DETAILED DESCRIPTION OF THE PREFERRED EMBODIMENT

Figure 1:
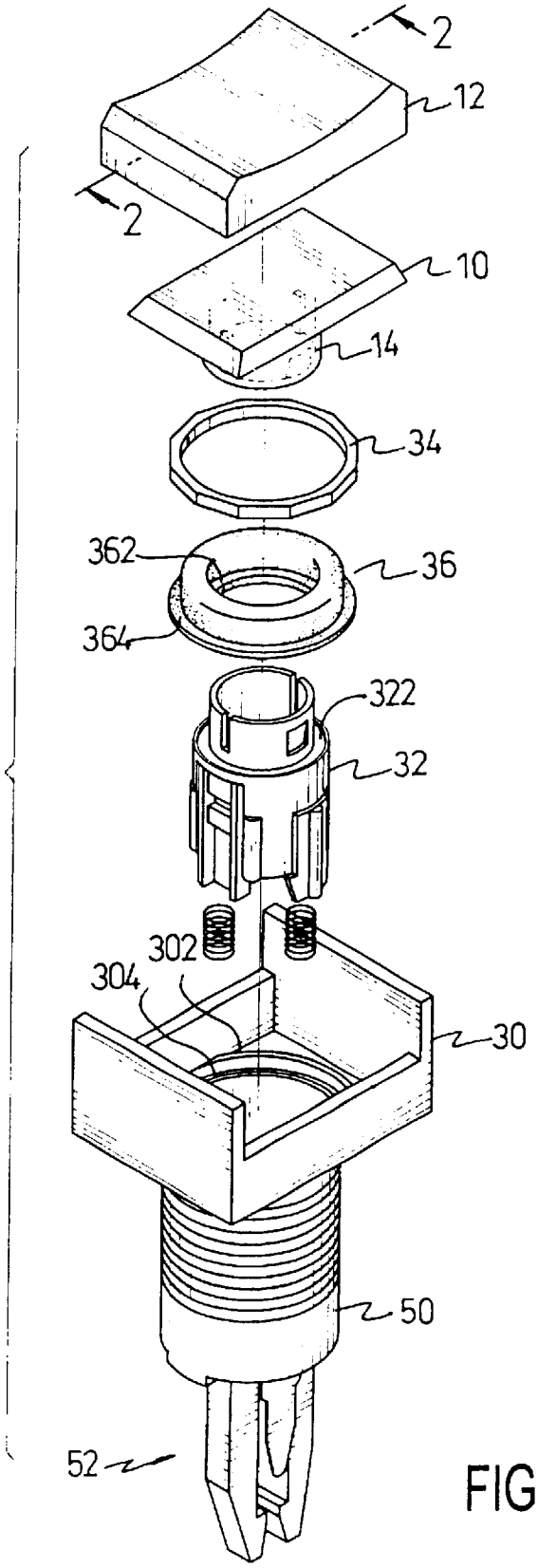
FIG. 1 is an exploded perspective view of a waterproof pushbutton in accordance with the present invention.

With reference to FIG. 1, waterproof pushbutton in accordance with the present invention consists of a body (50) with a distal end (52), a button housing (30) integrally and oppositely formed with a distal end of the body (50) relative to the distal end (52) and a cover (10). The cover (10) comprises an outer cover (12) detachably connected to a top face of the cover (10) and a hollow shaft (14) extending outward from a bottom face of the cover (10). The button housing (30) comprises an outer lip (302), an inner lip (304) and a retractable sleeve (32) removably received in the button housing (30) and provided with an annular shoulder (322). The sealing device comprises a compression fitting (34), and an elastic seal (36). The elastic seal (36) has an outer circumference (not numbered), and an inner circumference (not numbered). An outer flange (364) is formed on the outer circumference of the elastic seal (36), and an inner flange (362) is formed on the inner circumference of the elastic seal (36). Except for the sealing device, the pushbutton is conventional.

Figure 2:
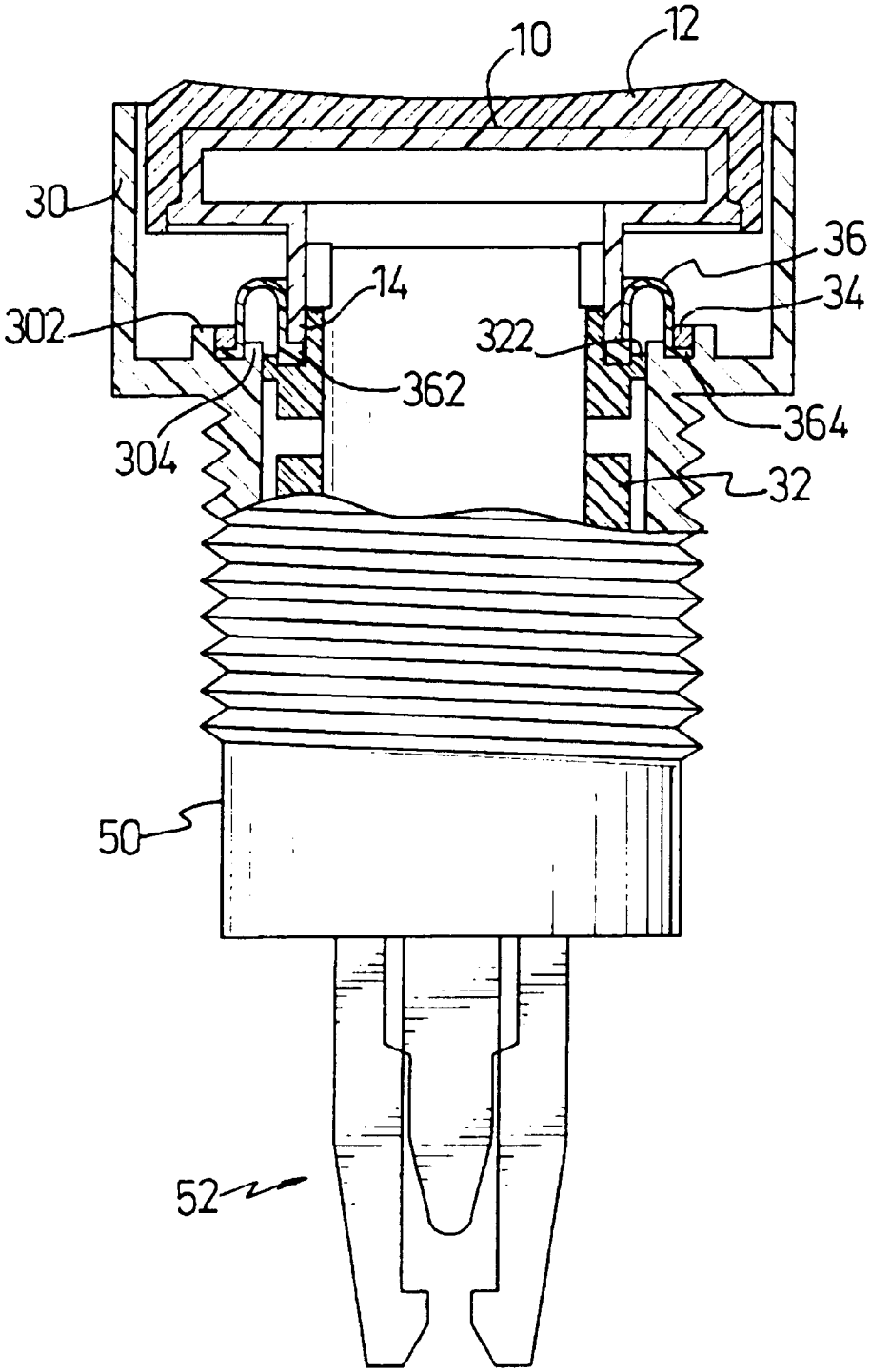
FIG. 2 is a side plan view in partial section of the waterproof pushbutton in FIG. 1.

With reference to FIG. 2, the button housing (30) is integrally formed with the body (50), and the retractable sleeve (32) is mounted in the hollow shaft (14) on the cover (10). The retractable sleeve (32) and the hollow shaft (14) of the cover (10) are slidably received in an internal opening (500) of the body 50 and partially extended out in the button housing (30). Two springs (38) are sandwiched between a bottom of an internal opening (500) of the body (50) and a bottom of the retractable sleeve (32) to provide a recovery force to the retractable sleeve (32). The elastic seal (36) is easily and slidably mounted on the annular shoulder (322) of the retractable sleeve (32), and the hollow shaft (14) of the cover (10) presses down on the inner flange (362) on the annular shoulder (322). The compression fitting (34) is mounted on the outer flange (364) of the elastic seal (36) to press the elastic seal (36) down between the outer and inner lips (302,304) of the button housing (30) body (50).

Figure 3:
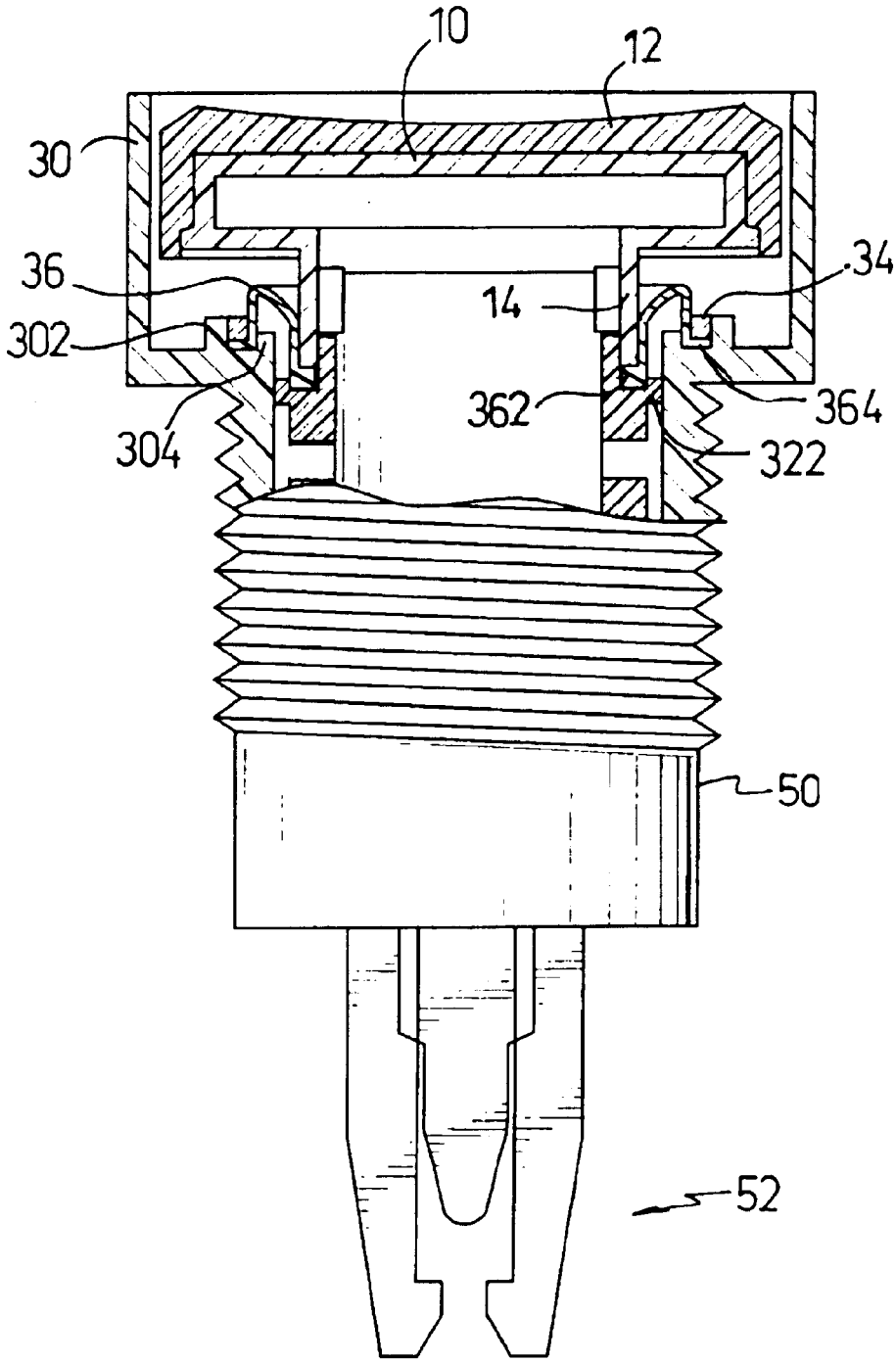
FIG. 3 is an operational side plan view in partial section of the waterproof pushbutton in FIG. 1.
Figure 4:
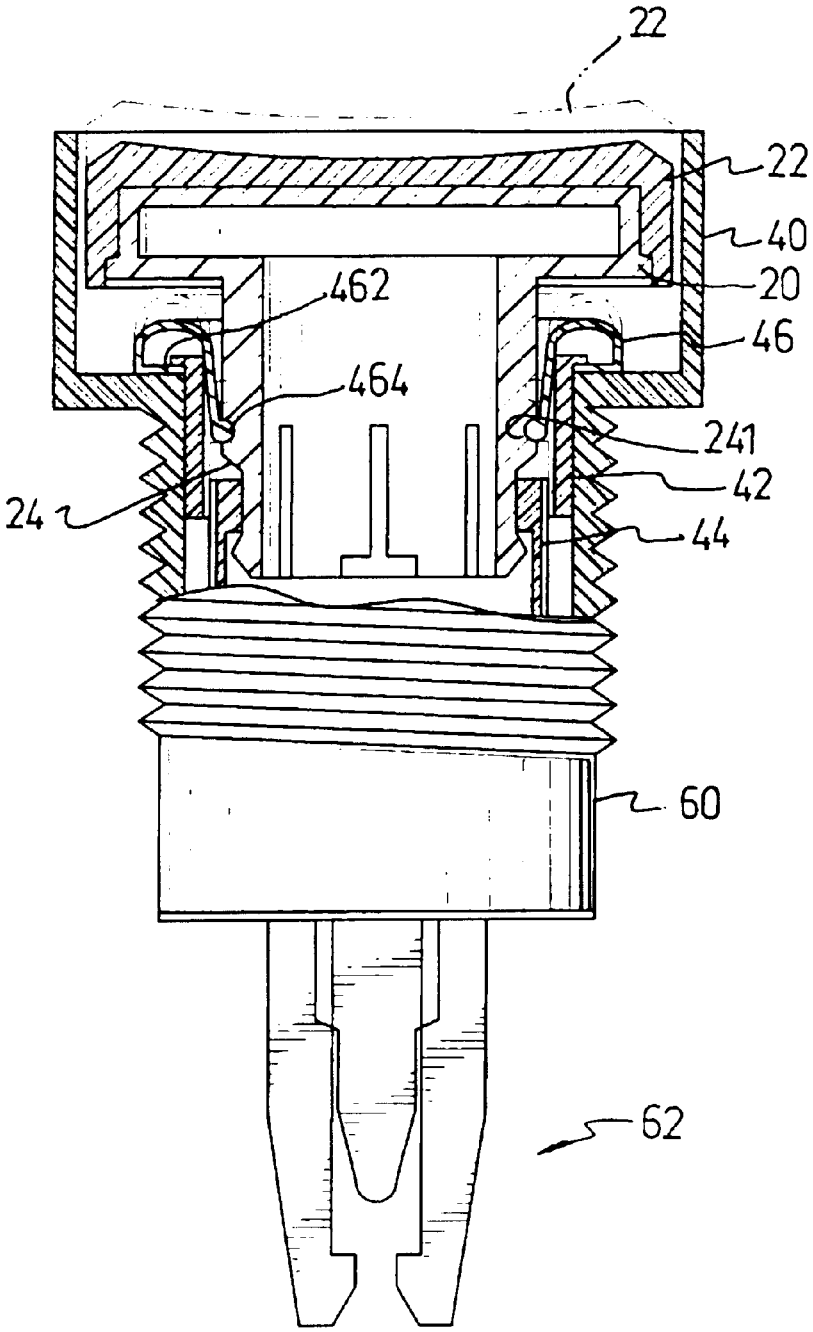
FIG. 4 PRIOR ART
FIG. 4 is a side plan view in partial section of a conventional sealing device for a pushbutton.

With reference to FIGS. 2 and 3, the inner flange (362) of the elastic seal (36) is mounted between the hollow shaft (14) and the shoulder (322). When the pushbutton is pushed down, the inner flange (362) of the elastic seal (36) is held down and deformed by the contact friction between the hollow shaft (14) and the elastic seal (36). However, the outer flange (364 of the elastic seal (36) is mounted between the compression fitting (34) and the inner and outer lips (302,304). Therefore, the elastic seal (36) is stretched on the inner flange (362) side, but the outer flange (364) side stays the same without permanent deformation. The advantage of this invention is to prevent the permanent deformation for the elastic seal and the to prevent leakage due to the elastic seal deformation when the pushbutton is pushed into the body (50).

It is noted from the drawing that after the elastic seal (36) is mounted on the annular shoulder (322) of the retractable sleeve (32) and the hollow shaft (14) is mounted on top of the inner flange (362), the inner flange (362) engages with the outer periphery of the retractable sleeve (32) and the outer flange (364) engages with the outerlip (302) of the button housing (30), which forms a double waterproofing effect to the pushbutton. Furthermore, due to the assembly arrangement of the pushbutton of the present invention, the extension of the hollow shaft into the elastic seal (36) is easy due to the outer diameter of the elastic seal (36) being slightly larger than that of the hollow shaft (14) and will not cause damage to the elastic seal (36).

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A waterproof pushbutton comprising:

a hollow body with a distal end extending from a bottom face of the body;

a button housing integrally formed on a top face of the body and defining therein an outer lip and an inner lip;

a retractable sleeve slidably received in the hollow body and having an annular shoulder formed on a top portion of the retractable sleeve;

an elastic seal having an inner flange engageable with an outer periphery of the retractable sleeve and an outer flange engageable with the outer lip of the button housing;

a compression fitting securely mounted on top of the outer flange to secure engagement between the outer flange of the elastic seal and the outer lip of the button housing to form a first waterproof effect of the pushbutton; and a cover detachably received in the hollow button housing and having a hollow shaft extending from a bottom of the cover to engage with the inner flange of the elastic flange to form a second waterproof effect of the pushbutton and an outer cover detachably connected to a top face of the cover.

* * * * *